United States Patent [19]

Hickey

[11] Patent Number: 4,917,542

[45] Date of Patent: Apr. 17, 1990

[54] PNEUMATIC GROUT REMOVAL METHOD FOR FORMING FOUNDATION STRUCTURES

[76] Inventor: Edwin W. Hickey, 3202 Shipping Ave., Coconut Grove, Fla. 33133

[21] Appl. No.: 209,079

[22] Filed: Jun. 17, 1988

[51] Int. Cl.[4] ..... E02D 5/56; E02D 7/22

[52] U.S. Cl. ..... 405/241; 405/239; 405/233; 405/231; 417/54; 417/65; 417/900

[58] Field of Search ..... 405/229, 230, 237, 238, 405/239, 240, 241, 242, 231; 417/54, 65, 900

[56] References Cited

U.S. PATENT DOCUMENTS

| | | | |
|---|---|---|---|
| 404,397 | 6/1889 | Geiser . | |
| 555,785 | 3/1896 | Misic et al. . | |
| 779,853 | 1/1905 | Hughes . | |
| 779,941 | 1/1905 | Hughes . | |
| 827,341 | 7/1906 | Young et al. . | |
| 1,217,128 | 2/1917 | White | 405/230 |
| 1,276,373 | 8/1918 | Jones . | |
| 1,334,638 | 3/1920 | Tucker . | |
| 1,729,422 | 9/1929 | Gleasner . | |
| 2,427,157 | 9/1947 | Piersol . | |
| 2,674,574 | 4/1954 | Pettas . | |
| 3,100,381 | 8/1963 | Case et al. | 405/239 |
| 3,228,200 | 1/1966 | Dufresne . | |
| 3,391,544 | 7/1968 | Daczko . | |
| 3,444,821 | 5/1969 | Wolsh . | |
| 3,807,184 | 4/1974 | Turzillo | 405/238 |
| 4,180,350 | 12/1979 | Watts . | |
| 4,650,367 | 3/1987 | Dietzler | 405/43 |

*Primary Examiner*—Dennis L. Taylor
*Assistant Examiner*—J. Russell McBee
*Attorney, Agent, or Firm*—Hovey, Williams, Timmons & Collins

[57] ABSTRACT

A practical method of forming foundation structures for buildings or the like is provided which allows economical and convenient formation of foundation piles and pile caps. In the preferred method hereof, an auger is drilled to a desired depth in the soil whereupon grout is pumped through the hollow shaft of the auger while the auger is removed to form a pile having an upper surface generally even with the initial grade level. A grout pump then removes grout from the pile down to a lower level generally slightly above the desired base level of a pile cap. After the grout hardens, the soil in the vicinity of the pile is removed to a level generally even with the upper surface of the pile whereupon a pile cap is poured onto the pile for at least partial support thereby.

7 Claims, 1 Drawing Sheet

PNEUMATIC GROUT REMOVAL METHOD FOR FORMING FOUNDATION STRUCTURES

BACKGROUND OF THE INVENTION

1. Field of the Invention

The present invention relates to a practical, economical, and convenient method of forming foundation structures. More particularly, the preferred invention hereof relates to a method of forming foundation piles and pile caps.

2. Description of the Prior Art

In the construction of large buildings such as multistory office buildings and other heavy structures, it is necessary to first provide a firm foundation. A typical foundation may comprise a number of footers. Each footer may typically include a plurality of columnar foundation piles supporting a pile cap which provides a base for the main structural components of the structure.

Patent No. 3,228,200 illustrates a commonly employed method for forming foundation piles. As disclosed in the '200 patent, a flighted auger with a hollow shaft is inserted, that is, bored or drilled into the soil, until the lower end of the auger is at the desired depth. Advantageously, this depth is at the level of bedrock or of sufficient depth to provide stable support for the pile and the building to be supported thereby. Pumpable grout is then discharged through the lower end of the auger shaft as the auger is moved upwardly so that the displaced soil is replaced by the grout until the top surface thereof is generally even with the initial grade of the soil. The grout so placed forms the foundation pile. Typically, a number of piles are constructed near one another in order to form a pile cluster.

It often happens, however, that the upper surface of the pile, which is generally even with the initial grade of the soil, is above the final desired bottom level of the pile cap to be supported by the pile. In such an event, the soil is removed in the vicinity of the pile down to the desired new grade level. That portion of the pile extending above the new grade level must then be removed by jackhammering or sawing so that the upper surface of the pile is generally adjacent the new grade level. The pile cap, typically formed of concrete, is then poured on top of the foundation pile. As those skilled in the art will appreciate, the process of cutting down the pile to the lower grade level is laborious, time consuming and expensive.

To solve this problem, some builders manually dip or remove grout from the newly formed pile before it hardens down to the desired grade level. This is also laborious, time consuming, and expensive and is particularly awkward when a reinforcing bar cage has been placed in the grout.

As an alternative, it may sometimes be possible to remove the soil in the vicinity of the planned foundation pile down to the level of the final grade before the foundation pile is formed, thus obviating the need for dipping the grout or later cutting down the the pile to the desired height. This may not be practical, however, because by removing the soil large holes are created throughout the construction site at the location of each pile or pile cluster. This in turn presents a hazard to vehicles operating on the construction site, or may prevent the use of some vehicles entirely, such as cranes or the like. Additionally, such holes collect water which must be pumped out before pouring of the pile cap, again adding additional labor and expense to the construction process. Furthermore, even if the grade is initially lowered in the vicinity of the planned pile(s), the soil displaced from the pile size as an auger bores the hole for the pile at least partially fills up the hole which then requires the use of a backhoe or the like to remove the displaced soil to again reestablish the desired grade level. The net result is that it is less expensive to pour the pile to the initially higher grade where the soil can be more conveniently removed by an end loader or the like, and then to later lower the grade level and cut down the height of the pile to the desired level.

Thus, the prior art points out the need for a method of forming concrete piles and pile cap which reduces the labor, time, and expense of known methods.

SUMMARY OF THE INVENTION

The problems as outlined above are solved by the method of the present invention. That is to say, the invention hereof provides a practical, economical, and convenient method of forming foundation piles and pile caps.

More particularly, the method hereof involves the steps of inserting a hollow shaft auger into the soil of the construction site until the lower end of the auger is at the desired depth, discharging grout from the lower end of the auger as it is removed from the soil, stopping the grout discharge when the upper surface thereof is at a level generally even with the initial grade level in the vicinity of the pile, and finally removing the grout from the pile using a grout pump which is insertable within the pile by pumping grout from the pile until the upper surface thereof is at the desired second pile level which is lower than the initial grade level.

Preferably, the method hereof also includes the additional steps of allowing the grout to harden, removing the soil in the vicinity of the pile down to a second grade level generally even with the upper surface of the pile, and then pouring concrete or the like onto the pile to form a pile cap at least partially supported by the pile. Advantageously, the steps of creating a foundation pile as recited above can be repeated to form a plurality of piles which support a single pile cap. Desirably, if soil conditions permit, the soil itself can be used as a form for the outer walls of the pile cap. Finally, the preferred method can include the step of inserting reinforcing bars into the grout before it hardens either before or after the step of removing the grout down to the second pile level.

BRIEF DESCRIPTION OF THE DRAWING FIGURES

FIG. 1 presents a partial side elevational view of the preferred grout pump used in implementing the the method of the present invention;

DETAILED DESCRIPTION OF THE PREFERRED EMBODIMENT

Figures 1, 2, 3, 4, 5, 6:
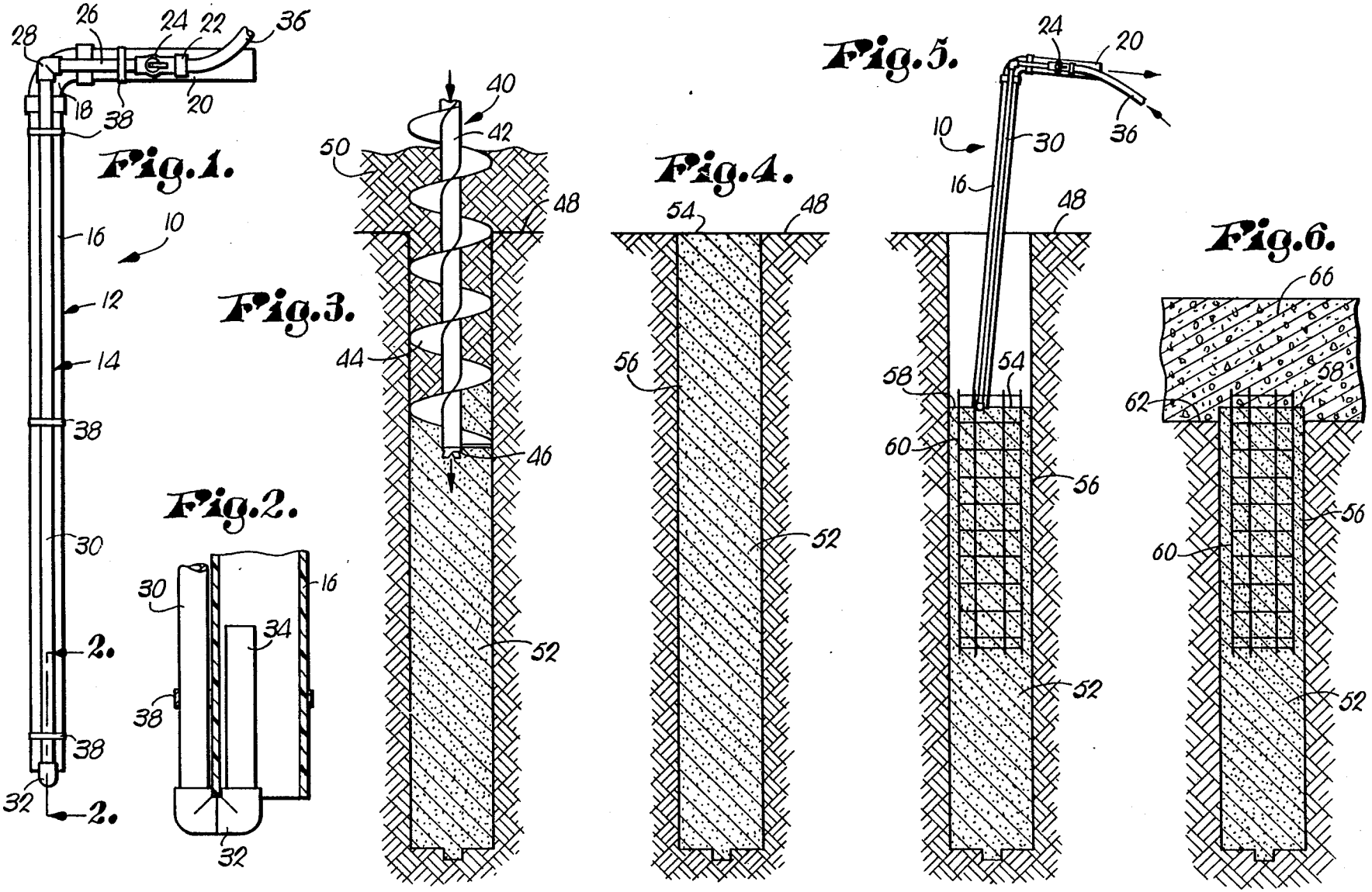
FIG. 2 is a partial elevational view in partial section of the lower end of the grout pump as shown in FIG. 1.
FIG. 3 is a sectional view illustrating the use of a pile auger being inserted into the soil of a construction pile.
FIG. 4 is a sectional view of a foundation pile with the top surface thereof generally even with the initial grade.
FIG. 5 is a view similar to FIG. 4 showing the level of the grout after removal of grout from the foundation pile by the grout pump.
FIG. 6 is a view of a foundation pile cap supported by the foundation pile.

FIGS. 1 and 2 illustrate the preferred grout pump 10 for use in connection with the present invention. Grout pump 10 broadly includes grout pipe 12 and air line 14.

Grout pipe 12 includes vertical pipe 16, elbow 18, and horizontal pipe 20 coupled to vertical pipe 16 by means of elbow 18 as shown. Preferably, pipe 16, elbow 18, and pipe 20 are composed of heavy wall polyvinyl chloride (PVC) for economy in manufacture and light weight.

Air line 14 is preferably constructed from pipe fittings serially connected and includes air hose coupling 22, valve 24, horizontal leg 26, elbow 28, down leg 30, two elbows joined to form reverse fitting 32 and outlet leg 34.

Air hose coupling 22 is adapted for quick coupling to flexible air line 36 conventionally supplying compressed from a source thereof air such as a portable air compressor (not shown).

Grout pipe 12 and air line 14 are securely joined in the arrangement as shown in FIGS. 1 and 2 by means of conventional hose clamps 38 to form grout pump 10. As constructed, grout pump 10 presents a cross-sectional area small enough to allow the lower end to be inserted into the grout of a foundation pile as will be explained further hereinbelow.

As those skilled in the art will appreciate, the use of PVC or other lightweight materials in the construction of grout pump 10 makes it suitable for portable operation whereby one person can easily manipulate the grout pump 10 by supporting the upper horizontal portion on the person's shoulder, for example. It should be noted, however, that grout pump 10 could also be composed of conventional steel pipe and fittings and manipulated by means of a crane, hoist, or the like if desired. The principles of operation of grout pump 10, which will be explained further hereinbelow, are well known to those skilled in the art as illustrated in Patent No. 1,729,422 which is hereby incorporated by reference.

FIG. 3 illustrates the use of pile auger 40 in connection with the present invention. Auger 40 includes tubular, grout-conveying, shaft 42 and helical flighting 44. Auger 40 is a conventional unit well known to those skilled in the art as illustrated in Patent Nos. 3,391,544 and 3,228,200, for example, which are hereby incorporated by reference. Auger 40 is capable of discharging grout under pressure from the lower end 46 thereof.

The method of the present invention provides a particularly economical, practical, and efficient method of constructing foundation piles and pile caps and is best understood with reference to sequentially arranged FIGS. 3–6.

Referring to FIG. 3, pile auger 40 is first inserted into the soil of the construction site to the desired depth. In conventional use, auger 40 is rotated so that flighting 44 digs into the soil of the construction site beginning at initial grade levels 48. As auger 40 rotates, the lower end thereof gradually extends into the soil while flighting 44 removes displaced soil 50 from the hole.

When lower end 46 reaches the desired final depth, grout 52 is discharged under pressure from lower end 46 as auger 40 moves upwardly. The upward movement of auger 40 may be accompanied by rotation to remove any remaining displaced soil 50 from the boring hole. As auger 40 moves upwardly, grout 52 replaces the displaced soil as shown in FIG. 3.

Auger 40 continues to discharge grout and to move upwardly until top surface 54 of grout 52 is generally adjacent initial grade level 48 as shown in FIG. 4. At this point, discharge of grout 52 from lower end 46 of auger 40 is stopped and auger 40 is moved out of the way. Grout 52, having replaced displaced soil 50, forms foundation pile 56. Displaced soil 50 can then be conveniently removed if desired, by an end loader or the like to reestablish initial grade level 48.

Referring now to FIG. 5, grout pump 10 is next moved into position with the lower end thereof inserted into grout 52 of foundation pile 56. Valve 24 is then opened which allows compressed air to flow through air line 14 to be discharged from outlet leg 34 into vertical pipe 16. The upward movement of the air through grout pipe 12 causes it to convey grout 52 therewith for discharge from the exposed end of horizontal pipe 20. Advantageously, the exposed end of horizontal pipe 20 may be in turn coupled to a flexible hose (not shown) for grout discharge.

Grout pump 10 quickly and conveniently removes grout 52 from pile 56 until the level of top surface 54 is lowered to second level 58 usually corresponding to the level of the bottom or base of the pile cap to be supported by pile 56. Grout pump 10 is then set aside.

Rebar cage 60 (constructed of reinforcing bars, rods, or the like), if specified in the building plans, is then installed into grout 52 of pile 56. Those skilled in the art will appreciate that rebar cage 60 may be installed before the grout level is lowered.

After grout 52 has hardened, the soil in the vicinity of pile 56 is removed down to new grade level 62 which is generally 4–6 inches below level 58. In so doing, and if soil conditions permit, the soil may be shaped to form a soil wall which can function as a form for the pouring of concrete pile cap 66. As shown in FIG. 6, pile cap 66 is poured on top of foundation pile 56 so that it is supported at least partially thereby. Typically, a number of foundation piles 56 are constructed with a single pile cap 66 supported by all of the piles.

Those skilled in the art will appreciate the practicality, convenience, and economy of the method described above. By using grout pump 10, the level of top surface 54 of pile 56 can be lowered to second level 58 relatively quickly and conveniently without the need for manual dipping of the grout from foundation pile 56. By so doing, the time consuming and expensive chore of removing the top portion of pile 56 by jackhammering, sawing or the like is eliminated. Furthermore, the risk of contaminating the top of the pile during manual dipping is substantially reduced.

I claim:

1. A portable pump for removing a pumpable substance such as grout or the like from a contained volume of said substance and for allowing a person to operate said pump which supporting the weight thereof, said pump comprising:

an elongated pumping unit including an elongated, tubular, substance-conveying member, said tubular member having a substance-entry end for insertion into said pumpable substance and a discharge end for discharge of said substance;

rigid support means for engaging the shoulder of a person for allowing the person to support said pump during operation thereof, and means for injecting a gas under pressure from a source thereof into said tubular member in the vicinity of said entry end, whereby injection of said gas into said tubular member while said member is generally upright and while said entry end is inserted in said substance allows said gas to rise in said tubular member to thereby convey said substance through said entry end and said tubular member for discharge from said discharge end, said pumping unit being composed of lightweight material such that the total weight of said pump is light enough to be supported by a person while operating said pump.

2. The pump as set forth in claim 1, said tubular member being configured to present a first section adjacent said entry end, said first section having a second end opposed to said entry end, and a second section adjacent said second end and generally perpendicular to said first section for being supported by a person, said rigid support member including said second section.

3. The pump as set forth in claim 1, said lightweight material including polyvinyl chloride.

4. A method of forming foundation piles within the soil at a construction site comprising the steps of:

forming an elongated, upright hole in the soil;

filling the hole to a desired first level with initially flowable, hardenable grout, providing grout pumping means including an elongated, tubular, grout-conveying pump body presenting a lower end and an upper, grout-delivery end, and composed of light-weight material such that the total weight of said pumping means is light enough to be supported by a person during operation thereof;

providing said pumping means with rigid support means for supporting said pumping means on the shoulder of a person during operation thereof;

inserting said pumping means lower end into the flowable grout to at least the level of a desired second pile level below the first grout level;

supporting said rigid support means on the shoulder of a person during operation thereof;

introducing a gas under pressure into said lower end for drawing grout thereinto for moving grout upwardly and along said pump body for delivery of grout from said pumping means delivery end to a remote location; and continuing to remove grout from the hole until the grout level therein is reduced to said desired second pile level in order to eliminate the need for reducing the level of said pile to said desired level after said grout hardens.

5. The method as set forth in claim 4, further including the steps of:

allowing said grout forming said pile to harden; and removing soil in the vicinity of said pile in order to form a second grade level generally slightly below said second pile level.

6. The method as set forth in claim 4, further including the step of pouring concrete or the like onto said pile to form a pile cap at least partially supported by said pile.

7. The method as set forth in claim 6, said step of removing soil including the step of removing soil so that the soil forms soil walls, said soil walls being a form for said pile cap.

* * * * *